United States Patent [19]

Shafer

[11] 4,084,816

[45] Apr. 18, 1978

[54] WORD GAME

[76] Inventor: Deborah L. Shafer, 2110 E. Lincoln, Royal Oak, Mich. 48067

[21] Appl. No.: 697,725

[22] Filed: Jun. 21, 1976

[51] Int. Cl.[2] ..... A63B 3/00

[52] U.S. Cl. ..... 273/1 R; 35/35 J; 273/299; 273/309

[58] Field of Search ..... 273/1 R, 130 E, 131 G, 273/134 AB, 135 D, 135 AA, 136 W, 130 R, 130 E; 35/35 J, 35 R

[56] References Cited

U.S. PATENT DOCUMENTS

| | | | |
|---|---|---|---|
| 1,491,536 | 4/1924 | Kaufman | 273/135 D X |
| 2,774,598 | 12/1956 | Strocco | 273/136 W |
| 3,263,347 | 8/1966 | McCutcheon | 35/35 R X |
| 3,678,602 | 7/1972 | Alam | 35/35 J |
| 3,823,492 | 7/1974 | Allain | 35/35 J |
| 3,873,093 | 3/1975 | Beskrone | 273/136 W X |
| 3,883,142 | 5/1975 | Spohn | 35/35 J X |

*Primary Examiner*—Paul E. Shapiro
*Attorney, Agent, or Firm*—Basile and Weintraub

[57] ABSTRACT

An educational and amusing game for evolving words comprising a plurality of word cards which are provided with two five-letter words having only one vowel combination and in which no one letter of the alphabet is repeated on any one word card. The object of the game is to completely spell out both words on a word card previously chosen by each participant by means of employing game pieces which are provided with letters, complete words, and vowel combinations which duplicate the letters, vowel combinations, and words of the two-word combinations formed on the word cards. The participants randomly draw upon a series of game pieces which selectively aid and/or impede the participants in their task of spelling out the words on a drawn word card.

6 Claims, 13 Drawing Figures

32

LOSE ALL CONSONANTS

EXCEPT FOR CONSONANTS IN A COMPLETE WORD CARD

Fig-6

34

LOSE ALL VOWELS

EXCEPT FOR VOWELS IN A VOWEL COMBINATION OR COMPLETE WORD CARD

Fig-7

36

FORFEIT ONE LETTER TO EVERY PLAYER

MUST CALL OUT LETTERS HELD IN HAND

Fig-8

37

LOSE NEXT TURN

Fig-9

38

ADVANTAGE CARD

CAN BE USED FOR A LETTER CARD THAT ANOTHER PLAYER DISCARDS

Fig-10

40

TAKE ONE LETTER FROM EACH PLAYER

* MUST ONLY ASK FOR DIFFERENT LETTERS

Fig-11

42

STOP!

Fig-12

44

FREE LETTER CARD

Fig-13

WORD GAME

BACKGROUND OF THE INVENTION

I. Field of the Invention

The present invention relates to a game and, more particularly, to an educational and amusing game dealing with the spelling of words.

II. Description of the Prior Art

While many educational and amusing games have been devised which, as their primary purpose, employ the use of the alphabet to permit the participants to spell out one or more words, the applicant is not aware of any game which utilizes word combinations in the manner proposed in applicant's invention. Further, while many previous games have provided entertainment and intellectual challenge, the applicant knows of no such game which involves the substantial improvement, interest, mental stimulation, educational experience, and enjoyment which is provided by applicant's game.

Examples of the prior art games which are known to applicant are U.S. Pat. No. 2,071,014 issued on Feb. 16, 1937, to Akers and U.S. Pat. No. 3,704,018 issued on Nov. 28, 1972, to Fyanes.

SUMMARY OF THE INVENTION

The present invention, which will be described subsequently in greater detail, comprises a plurality of game pieces including a series of word cards each having two five-letter words with one vowel combination and no one letter of the alphabet being repeated. A series of game pieces including complete word cards, letter cards, and vowel combination cards are provided and are in duplication of certain of the words, letters, and vowel combinations of the words on the word cards.

It is therefore an object of the present invention to provide an improved game involving complete spelling out of a selected number of words by a participant in competition with other participants.

It is a further object of the present invention to provide a new and improved word spelling game which has a format adaptable to any academic, vocational, professional, or interest area, yet one which may be played and enjoyed by children and adults alike.

Other objects, advantages, and applications of the present invention will become apparent to those skilled in the art of word games when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIGS. 6 through 9 are plan views of the faces of four types of game pieces in the form of playing cards which function to penalize participants of the game; and FIGS. 10 through 13 are plan views of the faces of four types of game pieces in the form of playing cards which are used to aid the participants in spelling out the words on the game piece illustrated in FIG. 2.

DESCRIPTION OF THE PREFERRED EMBODIMENT

Figure 1:
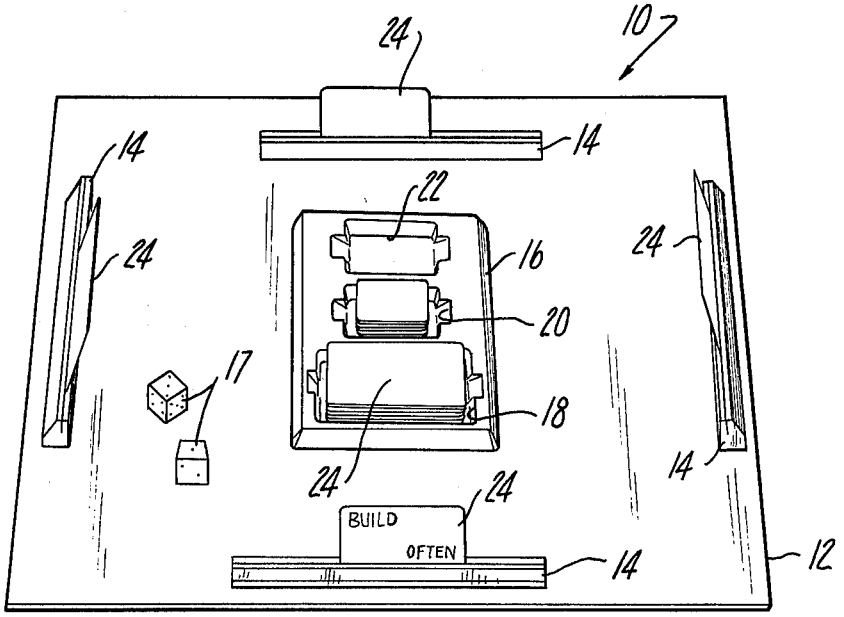
FIG. 1 is a perspective view of a game board at appreciably reduced scale which is employed in the described embodiment of the inventive word game.

Referring now to the drawings and, in particular, to FIG. 1 wherein there is illustrated one example of the present invention in the form of a word game 10 comprising a suitable game board 12 having a plurality of card racks 14 strategically located about the board to permit a participant to sit in front of a card rack 14 and position his cards thereon in a manner which permits the cards to be concealed from the remaining participants, all of which will be described in greater detail hereinafter. It should, however, be understood that while FIG. 1 illustrates the use of four card racks 14, the present inventive game may employ between two and eight participants in individual competition. Additionally, team competition may be utilized wherein several participants function as a team and several teams are in competition with one another.

The game 10 further comprises a central card tray 16 having a plurality of recesses 18, 20, and 22 respectively for the receipt of game pieces in a manner which will be described in greater detail hereinafter. A pair of dice 17 is used during the play of the word game 10, as will be described hereinafter.

Figure 2:
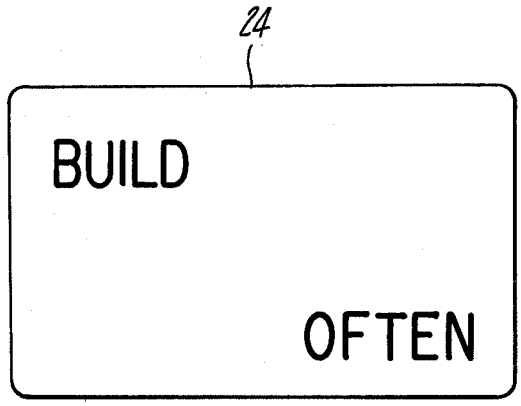
FIG. 2 is a plan view of the face of a game piece in the form of a word card.

Referring now to FIG. 2 wherein there is illustrated one example of a game piece in the form of a word playing card 24. In the present invention fifteen word playing cards 24 are employed with each word card containing two five-letter words. Additionally, each word playing card 24 has only one vowel combination; that is, two vowels side by side. In the example illustrated in FIG. 2 the words "BUILD" and "OFTEN" are used. The vowel combination is the letters "UI." Additionally, no one letter is repeated on any one word playing card 24; that is, each card will have ten different letters. While other combinations may be devised, the following combinations of words are preferred for the fifteen word cards:

| | |
|---|---|
| BUILD - OFTEN | HUMOR - YEAST |
| PROVE - SAUCY | QUILT - GROWN |
| JOINT - SHAPE | HEART - FLOCK |
| DAIRY - SLUMP | FRUIT - ELBOW |
| UNTIL - REACH | WEIGH - CRUMB |
| BREAD - MONTH | TOUGH - CRAZY |
| PROUD - KNIFE | DOUBT - ANVIL |
| INDEX - QUOTA | |

Figure 3:
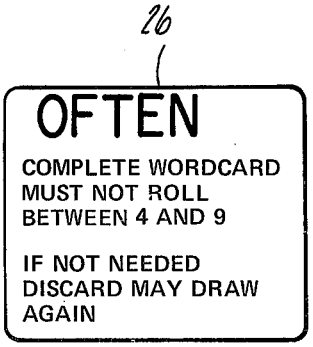
FIGS. 3 through 5 are plan views of the faces of three types of game pieces in the form of playing cards which are used by the participants to spell the words on the game pieces of the type illustrated in FIG. 2.

Referring now to FIG. 3 for an example of the second playing piece in the form of a complete word playing card 26. In the present game fifteen complete word playing cards 26 are employed. The cards 26 enable the participant to spell out one of the words on the word playing cards 24. Since there are thirty words, it necessarily follows that there must be fifteen word playing cards 26, one card 26 for each word card 24. As will be described in greater detail hereinafter in the description of the method of playing the inventive game, each of the complete word playing cards 26 has instructions thereon as to what the participant must do in rolling the dice 17 in order to be able to retain the complete word card 26. In the example illustrated in FIG. 3, in order for the participant to retain the word "OFTEN," it will be necessary for the participant to roll the dice and roll between the numbers four and nine. It should be understood that many examples as to conditions for retaining the card may be devised. For example, the participant could be required to roll an odd number, an even number, or be required to roll a number which is not one of the designated group of numbers. In the present game the following group of words is preferred to be used on the complete word playing cards 26:

| | |
|---|---|
| OFTEN | HUMOR |
| PROVE | GROWN |
| SHAPE | FLOCK |
| SLUMP | ELBOW |
| UNTIL | CRUMB |
| MONTH | CRAZY |
| KNIFE | ANVIL |
| INDEX | |

Figure 4:
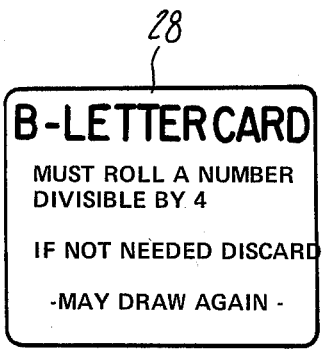

These cards, when drawn, must be placed face up for all other participants to see. Referring now to FIG. 4 for an example of yet another playing piece in the form of a letter playing card 28. There are fifty-two letter playing cards 28 which are utilized by the participants to help spell out the words on the word playing card 24 drawn by each participant. Each card contains one letter of the alphabet and requires a roll of the dice in order to retain the letter card. Instructions for what the participant must roll with the dice 17 are provided for on the face of the card. Additionally, the letter card provides information and instructions as to what the player must do with the card 28 and whether or not the player may draw again, all of which will be described in greater detail hereinafter with respect to the description of the method of playing the game. In the preferred game there are two cards for each letter of the alphabet; namely, fifty-two cards. These cards, when drawn, must be placed face up in view of all other players.

Figure 5:
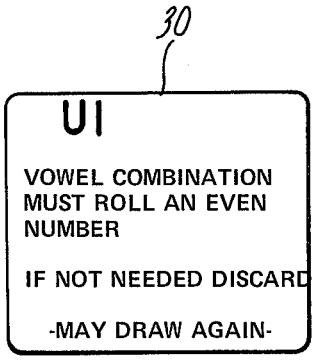

Referring now to FIG. 5 for yet another example of a game piece in the form of a vowel combination playing card 30. There are seven vowel combination playing cards 30 which enable a player to gain two essential letters. Each of the vowel combination playing cards 30 contains two vowels, and the participant must roll the dice in a manner which comforms to the instructions set forth on the card 30 in order to retain the card 30. While there is a vowel combination card 30 for each word card 24, there are a number of word cards which use the same vowel combination. Since there is only one such combination card 30 for each particular vowel combination, participants may be competing to obtain the same card. This becomes of value hereinafter when several of the other game pieces are described in conjunction with the method for playing the inventive game. In the present game the following group of vowels is preferred to be used on the vowel combination playing cards 30: AI, AU, EA, EI, OI, OU, and UI. These cards, when drawn, must be placed face up in view of all other participants.

Referring now to FIGS. 6 through 9 which illustrate a variety of game pieces which are utilized throughout the game 10 to penalize the various participants.

Referring to FIG. 6, there is illustrated a game piece in the form of a "LOSE ALL CONSONANTS" playing card 32. There is only one such card in the game 10; and when drawn by the participant, this card results in the taking away of all separate consonants in the participant's hand. When the participant draws this card, he must discard the separate consonants in his hand; however, this playing card 32 may not take the consonants out of a complete word card 26. This card, when drawn, must be placed face up in view of all other participants.

Referring to FIG. 7, there is illustrated an example of a game piece in the form of a "LOSE ALL VOWELS" playing card 34. The game 10 utilizes one such playing card, and it is similar to the "LOSE ALL CONSONANTS" playing card 32 in the manner in which it is used. When a participant draws the "LOSE ALL VOWELS" playing card 34, the participant must discard all the separate vowels in his hand; however, the participant need not take the vowels out of a complete word card 26 or a vowel combination card 30. Only one "LOSE ALL VOWELS" playing card 34 is utilized in the inventive game 10. This card, when drawn, must be placed face up in view of all other participants.

FIG. 8 illustrates a game piece in the form of a "FORFEIT ONE LETTER TO EVERY PLAYER" playing card 36. When a participant draws the card 36, the participant must give up a letter to each of the remaining participants. The participant who draws the card 36 must start calling off the letters in his hand one by one. If none of the letters that the participant has called off are needed, the participant has been saved and the card 36 may be returned to the discard recess 22 on the card tray 16. If another participant desires one of the called-out letters, he simply asks for it. If, by chance, two participants need the same letter, the first participant on the left of the participant who drew the card 36 obtains the letter card. These cards, when drawn, must be placed face up in view of all other participants.

Referring now to FIG. 9 wherein there is illustrated a penalty game piece in the form of a "LOSE NEXT TURN" playing card 37. Only two such playing cards 37 are provided in the inventive game 10; and when drawn, a participant must lay the card 37 face up allowing the other participants to view it. Even though this participant has lost his turn, it does not leave him out of the game. For example, if a second participant draws the "TAKE ONE LETTER" card 40 (which will be described hereinafter), the second participant may take a letter from the first participant who has lost his turn; but when another player draws a "FORFEIT ONE LETTER" card, the player who has lost his turn cannot take a letter from the player who has to forfeit letters.

Referring now to FIGS. 10 through 13 wherein there is illustrated a plurality of playing pieces which are used to the advantage of the participants.

FIG. 10 illustrates a playing piece in the form of an "ADVANTAGE" playing card 38 that is used by the drawing participant to obtain either a letter, vowel combination, or a complete word card that another player has discarded. There are a total of six "ADVANTAGE" cards 38 with there being two "ADVANTAGE" cards for each set; namely, two for the letter cards, two for the vowel combination cards, and two for the complete word cards. When another participant discards a letter card, a vowel combination card, or a complete word card, the participant who is holding an "ADVANTAGE" card has the option to obtain that card depending on what the "ADVANTAGE" card may be used for. That participant may take the discarded playing card without rolling the dice and place that card in his hand. Once the "ADVANTAGE" card has been played by a participant, that participant must discard it into the recess 22 of the card tray 16. These cards, when drawn, must be placed face up in view of all other participants.

Referring now to FIG. 11 wherein there is illustrated a game piece in the form of a "TAKE ONE LETTER FROM EACH PLAYER" card 40. There are two such playing cards 40; and when one is drawn, a participant has the right to take a letter from each of the other participants in the game 10. The drawing participant may only ask his opponents for a different letter; for example, if four players are playing, the participant who draws the card can ask each participant in succession for a particular letter, that letter being different from the ones asked the preceding participants. If none of the players have the called letters, the card 40 is lost and must be returned to the discard recess 22 of the card tray 16. These cards, when drawn, must be placed face up in view of all other participants.

Referring now to FIG. 12 wherein there is illustrated yet another example of a game piece in the form of a "STOP" playing card 42. "STOP" cards 42 and "FREE LETTER" cards 44 (which will be described hereinafter) are the same in color, but they differ in color from all other playing cards. "STOP" and "FREE LETTER" cards go directly into the player's hand when drawn, unlike all other playing cards which, when drawn, are placed face up in view for all participants to see. There are four such "STOP" playing cards 42 in the inventive game, and these cards function to void the powers of certain playing cards heretofore described and generally can be used to stop most other playing cards from entering another participant's hand. Once such a "STOP" card 42 has been used in the manner to be described hereinafter, it must be discarded into the recess 22 of the card tray 16 by the using participant.

The "STOP" cards 42 may be used in the following manner:

1. When a participant is rolling the dice 17 for either a letter playing card 28, a vowel combination playing card 30, or a complete word 26, a second participant who may be holding a "STOP" playing card 42 may place the "STOP" card 42 on that first participant and thus prevent the first participant from obtaining the drawn card.

2. If a participant who is holding a "STOP" card 42 draws either the "LOSE ALL VOWELS" card 34, the "LOSE ALL CONSONANTS" card 32, or the "FORFEIT ONE LETTER" card 36, that participant may use his own "STOP" card to void the directives or "powers" of these playing cards.

3. A "STOP" card 42 may be utilized to stop another "STOP" card which, in turn, may be utilized to stop a third "STOP" card. For example, if the first participant places a "STOP" card 42 on a second participant and that second participant has a second "STOP" card, then that second participant may place his "STOP" card on top of the first participant's "STOP" card and thereby avoid the first "STOP" card. If, however, the first participant should have a third "STOP" card in his hand, he could then use that third "STOP" card and place it against the second participant's "STOP" card. This procedure could go on as long as the participants are holding "STOP" cards.

4. "STOP" cards 42 cannot be used to stop the directives or "powers" of certain of the playing cards; namely, the "STOP" cards 42 may not be used to stop the powers of the "FREE LETTER" card 44 (which will be described hereinafter), the "TAKE ONE LETTER" card 40, the "LOSE THE NEXT TURN" card 37, and the "ADVANTAGE" card 38.

Referring now to FIG. 13 for a description of the remaining playing item, there is illustrated a "FREE LETTER" playing card 44 which enables a participant to gain letters without rolling the dice. The cards 44 may be used in place of any letter, and a player may have as many "FREE LETTER" cards as in his hand. Normally and preferably eight such "FREE LETTER" cards 44 are used in the present game. A "FREE LETTER" card may be moved around the player's hand to act as different letters as required. An example of this situation would be when a participant needs the letter "B," the participant may use the "FREE LETTER" card 44 for the letter "B." However, if during the course of the game the participant draws a letter card 28 having the letter "B" thereon, the participant may play for that letter; and if he rolls the dice 17 as required on the letter card 38, the participant may place the letter card 38 in his hand. At this point in time the participant could use the "FREE LETTER" card 44 for a different letter, as required. Obviously, this procedure could be repeated as often as needed. Additionally, the "FREE LETTER" card 44 may not be lost, taken, or forfeited from a participant's hand at any time during the course of the game 10.

In use, the participants position themselves about the board 12 with each participant being seated in front of a card rack 14. The word cards 24 are positioned face down in the recess 18 of the card tray 16, and the one-hundred playing cards are positioned within the playing card recess 20. The discard recess 22 remains empty and is utilized for storing discarded playing cards. The initial play of the game commences with each participant drawing a card from the word card pile. The participants each place their word card on the card rack 14 so that the other participants will not see the chosen word cards. After every participant has drawn a word card, the remaining word cards 24 may be set aside, for they will not be used during the duration of the game.

Each participant then rolls the dice 17 for the first play with the highest roll being the first to commence the game 10 and with the play moving in a clockwise rotation from participant to participant.

After it has been determined who shall go first, the first participant draws a card from the playing card deck. As aforementioned, each playing card states the directions thereon which the participant must comply with in order to be able to retain the card. For example, if the player were to have drawn the complete word card 26 (illustrated in FIG. 3), he would have to roll the dice and come up with a total number which was not between four and nine. If the participant desires to retain the card 26, he would have to lay it face up in order for the other participants to see it. He would then roll the dice 17 as stated on the card; and if the participant rolls the dice requirement, he may then place that playing card 26 in his hand. However, if the player loses the roll, he places the card 26 within the discard recess 22, and the play moves to the next participant.

If the participant does not need the card that has been drawn, he may either discard it and the play goes to the next participant, or the first participant may draw again. This depends upon the instructions carried on the card that is drawn. For example, in the word card 26 illustrated in FIG. 3, the participant may discard the card if not needed and draw again; on the other hand, the card 26 could provide that if the card 26 is not needed, it must be discarded and the play must move to the next participant. This rule only applies to participants who do not need the card, since if the player needs the card, rolls the dice 17, and loses the card by not rolling the dice 17 in the manner set forth in the card instructions, then the participant must discard the card and he may not draw again.

Certain highlights of the game should be pointed out to the user so that the fullest enjoyment of the game may be had. In the situation where a participant has drawn either a vowel combination card 30 or a complete word card 26 and the participant manages to retain it through all of the aforementioned obstacles, the participant may place the card in his hand; and whatever cards he may have had in his hand to construct the particular replaced word may be discarded. For example, if a participant that is trying to spell the word "OFTEN" and the participant has in his hand the letters "O," "E," and "N" and the participant draws the complete word card 26 for the word "OFTEN," if would be advantageous for the participant to use the complete word card and discard all of the other letter cards; namely, "O," "E," and "N." The reason for this is that the word card is protected, while the individual letters may be forfeited by use of certain of the aforementioned disadvantage cards illustrated in FIGS. 6 through 9 of the drawings.

If a participant is holding a "STOP" card, the participant may wish to save this to stop another player from obtaining a complete word card rather than utilizing and perhaps wasting the "STOP" card just to prevent an opponent participant from obtaining a letter card. Additionally, a participant may wish to hang on to his "STOP" card and use it only to protect himself, rather than to use it to the disadvantage of his opponents.

It may be also advantageous to observe what other participants are playing for, for you may draw the card "TAKE ONE LETTER FROM EACH PLAYER" and by observing what letter cards the other participants have picked up, a participant will have an approximate idea of what the other participants are holding in their hands; and therefore the participant may be able to use this card 40 to its fullest extent.

The method of playing the inventive game moves in a clockwise manner around the game board 12, and the first participant who has completely spelled out both of the words on his word card 24 wins the game.

While only one example of the present invention has been disclosed, it should be understood by those skilled in the art of word games that other forms of the invention may be had, all coming within the spirit of the invention and the scope of the appended claims.

What is claimed is as follows:

1. A game having a plurality of game pieces for use in evolving word combinations, said game comprising:

a game board;

a plurality of game piece racks strategically located about said game board to permit a participant to sit adjacent one of said racks and to position game pieces on said one rack in such a manner that written indicia on said game pieces is viewable by said participant, while said written indicia is concealed from the remaining participants and said remaining participants are adjacent the other of said plurality of racks;

a card tray carried by said game board in a location which is central to said game piece rack so as to provide a space between said racks and said tray for the positioning of selected game pieces thereon, said tray having first, second, and third laterally spaced recesses, said first recess being sized so as to be larger than said second and third recesses, said second and third recesses being substantially the same size, said third recess being adapted to store discarded game pieces;

a plurality of first game pieces, each being a word card of a size complementary to the size of said first recess and having a series of words thereon wherein each series of words has one vowel combination and different letters of the alphabet, said first card being stored in said first recess of said tray and being adapted to be selected therefrom and stored in said racks;

a plurality of second game pieces, each of said second game pieces being of a size complementary to the size of said second recess and having a letter of the alphabet thereon, said second game pieces being stored in said second recess of said tray and selected numbers of said second game pieces being positionable on said racks;

a plurality of third game pieces, each of said third game pieces being a card of a size complementary to said second recess and having in duplication certain of the words on said first game pieces, said third game pieces being stored in said second recess and a selected number thereof being adapted to be stored in said racks;

a plurality of fourth game pieces, each being a word card of a size complementary to the size of said second recess and having in duplication certain of the vowel combinations on said first game pieces, said fourth game pieces being stored in said second recess, a selected number of said fourth game pieces being stored in said racks;

a plurality of fifth game pieces, each being a word card of a size complementary to the size of said second recess and having instructions thereon causing the drawing participant to forfeit a turn, said fifth game pieces being stored in said second recess and adapted to be positioned in said space between said tray and said racks; and a plurality of dice for determining whether a participant will retain one of the aforementioned game pieces during the course of play.

2. The game defined in claim 1 further comprising a sixth game piece in the form of a card having a size complementary to the size of said second recess and having instructions thereon which permit said sixth game piece to be selectively substituted for one of said second game pieces.

3. The game defined in claim 1 further comprising a sixth game piece in the form of a card having a size complementary to the size of said second recess and having instructions thereon wherein the drawing participant must forfeit a selected number of said second game pieces.

4. The game defined in claim 1 further comprising a sixth game piece in the form of a card having a size complementary to the size of said second recess and having instructions thereon wherein the drawing participant may selectively receive one or more of said second game pieces from the remaining participants.

5. The game defined in claim 1 further comprising a sixth game piece in the form of a card having a size complementary to the size of said second recess and having instructions thereon permitting the drawing participant to selectively receive said second, third, and fourth game pieces from the remaining participants of said game.

6. The game defined in claim 1 further comprising a sixth game piece in the form of a card having a size complementary to the size of said second recess and wherein the drawing participant may use said sixth game piece to prevent the other participants from drawing said second, third, or fourth game pieces.

* * * * *